United States Patent [19]

Lin

[11] Patent Number: 4,880,023

[45] Date of Patent: Nov. 14, 1989

[54] UMBRELLA FRAME

[76] Inventor: Cheing-Young Lin, No. 6, Alley 23, Lane 273, Sec. 3, Tungmen Rd., Tainan Hsien, Taiwan

[21] Appl. No.: 252,857

[22] Filed: Oct. 3, 1988

[51] Int. Cl.[4] ..... A45B 3/00

[52] U.S. Cl. ..... 135/25 R; 135/16; 135/20 R

[58] Field of Search ..... 135/16, 25 R, 26

[56] References Cited

U.S. PATENT DOCUMENTS

| | | | |
|---|---|---|---|
| 1,310,399 | 1/1919 | Levin | 135/16 |
| 4,641,675 | 2/1987 | Wu | 135/25 R |
| 4,739,783 | 4/1988 | Yang | 135/25 R |
| 4,760,610 | 8/1988 | Wu | 135/16 |

*Primary Examiner*—Henry E. Raduazo

*Attorney, Agent, or Firm*—Renner, Otto, Boisselle & Sklar

[57] ABSTRACT

An umbrella frame including a telescopic stick, outer dome ribs, struts, and stretcher members, in which the telescopic stick is provided with a crown at its upper end and is further provided with a runner which is slidable along the stick. The umbrella frame further includes two looped-shaped ribs provided on the runner, two braces which are connected at one end to a pivotal joint of the stretcher member and which are connected at the other end to the looped-shaped ribs so as to support the ribs, and two catchers for fixing the corresponding rib.

8 Claims, 6 Drawing Sheets

UMBRELLA FRAME

BACKGROUND OF THE INVENTION

The present invention relates generally to umbrella frames, and more particularly, to an umbrella frame which further includes a pair of extended structures to define a novel umbrella frame.

Heretofore, umbrellas have been developed mainly for functionability as from non-telescopic to telescopic and further from manual control telescopic to push-button telescopic. In addition, umbrella frames have been covered with canopies of various colors and patterns. However, the umbrella frame per se has remained in its old and unchanged dome shaped structure for decades.

SUMMARY OF THE INVENTION

It is therefore a primary object of the present invention to provide an umbrella frame which offers a breakthrough in conventional dome-shaped umbrella structures.

Another object of the present invention is to provide an umbrella frame which further includes a pair of extended ribs from the normal dome shape portion of the umbrella.

A further object of the present invention is to provide an umbrella which has a pair of animal ears extending from the dome-shaped portion when in open position.

These and other objects of the present invention will be apparent after reading the detailed description provided hereinbelow, with appropriate reference to the attached drawings.

DETAILED DESCRIPTION OF THE PREFERRED EMBODIMENT

Figure 1:
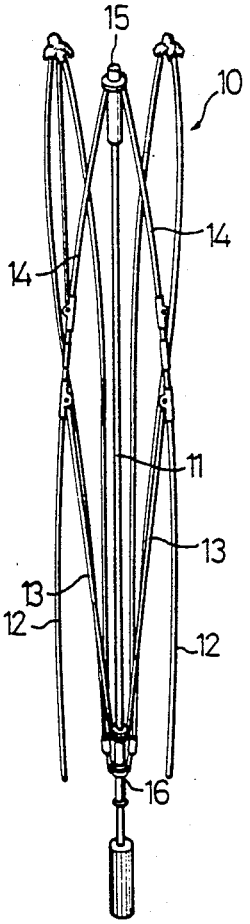
FIG. 1 is a perspective view of an umbrella frame in accordance with the present invention shown in folded form.
Figure 2:
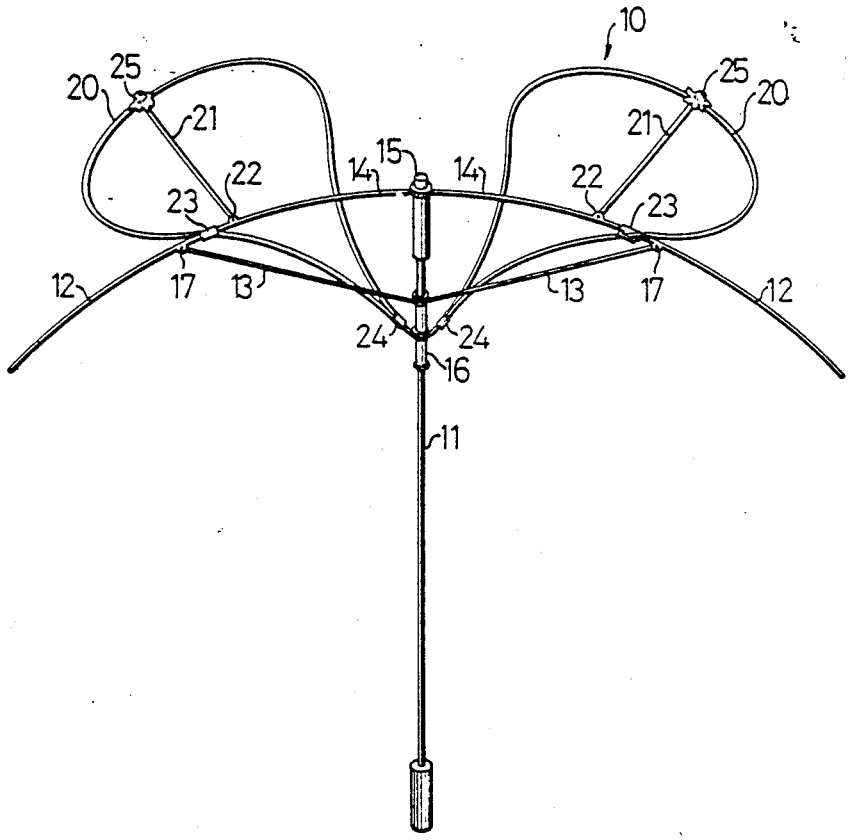
FIG. 2 is a side elevational view showing the umbrella frame of FIG. 1 in expanded form.

Referring to the drawings and initially to FIGS. 1 and 2, it can be seen that an umbrella frame constructed in accordance with the present invention is designated by the reference numeral 10. The umbrella frame 10 includes a telescopic stick 11, a plurality of outer dome ribs 12, a plurality of struts 13, and a plurality of stretcher members 14. It should be noted that FIGS. 1 and 2 have been simplified by illustrating only two of each plurality of the elements 12, 13 and 14. The telescopic stick 11 is provided with a crown 15 at an upper end thereof and is further provided with a runner 16 which is slidable therealong. The crown 15 is connected to the stretcher member 14 and the runner 16 is connected to the struts 13. The strut 13 is connected to the runner 16 at one end as mentioned previously and to a first pivotal joint 17 on the stretcher member 14 at the other end. The stretcher member 14 is connected to the crown 15 at one end, as mentioned previously, and to the first pivotal joint 17 at the other end.

Figure 3:
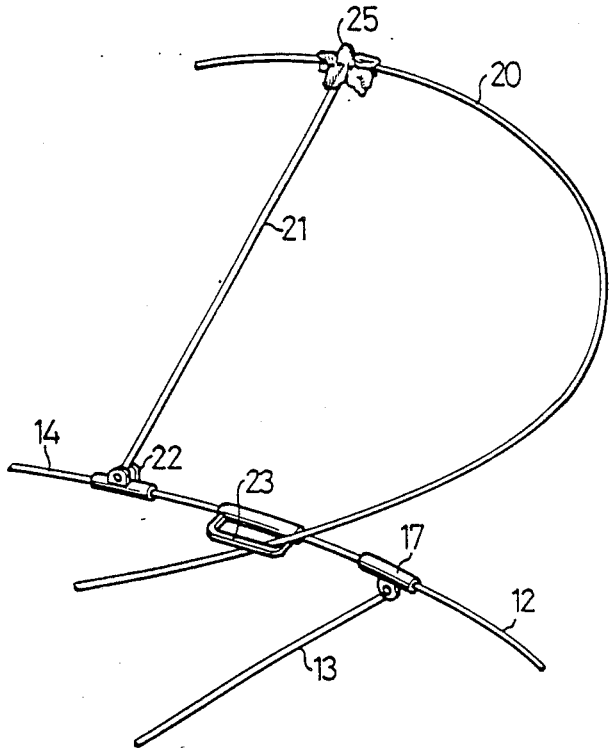
FIG. 3 is a close-up view of the loop-shaped rib of the expanded umbrella frame of FIG. 2.

Referring to FIGS. 2 and 3, it is an important feature of the present invention that the umbrella frame 10 further includes two looped-shaped ribs 20, two braces 21, and two catchers 23. The two looped-shaped ribs 20 are provided on the runner 16. One end of the two braces 21 are connected to a second pivotal joint 22 of the stretcher member 14 and the other end of the braces are connected to the looped-shaped ribs 20 so as to support the ribs 20. The two catchers 23 are formed on two corresponding stretcher members 14 between the first pivotal joint 17 and the second pivotal joint 22 for fixing the corresponding rib 20 or to define a route for the rib 20. The looped-shaped rib 20 is constructed in a looped-shaped form by having its two end portions joined together by a sleeve 24 and fastened on the runner 16 in a manner which will be explained hereinafter. The connection part of each rib 20 and each brace 21 is covered by a cover cloth 25.

Figure 4:
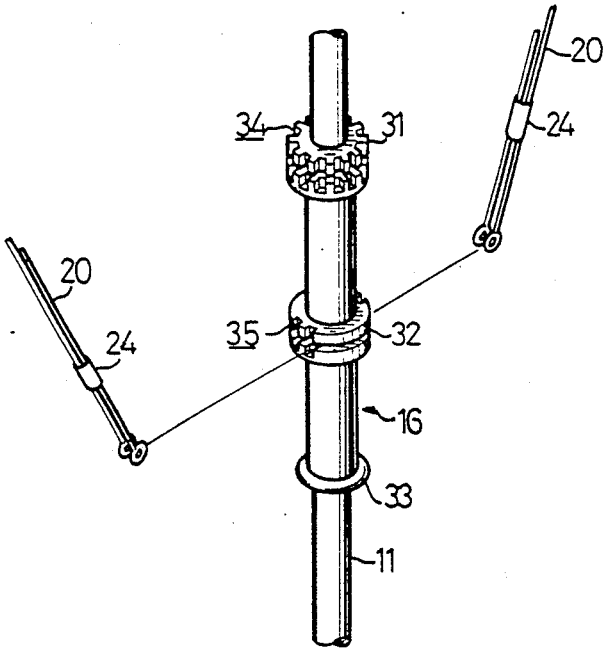
FIG. 4 is a close-up exploded view of the umbrella frame of FIG. 2 showing the connection of the ribs and the runner of the umbrella frame.

Referring next to FIG. 4, it can be clearly seen that the runner 16 is of a sleeve form and includes three annular protrusions, namely an upper annular protrusion 31 a middle annular protrusion 32, and a lower annular protrusion 33. The upper annular protrusion 31 includes a plurality of first cutouts 34 for pivotal engagement with the plurality of struts 13. The middle annular protrusion 32 includes two second cutouts 35 for pivotal engagement with the looped-shaped rib 20 having both end portions joined together by a sleeve 24. The lower annular protrusion 33 is provided for the user to push upon so as to open the umbrella.

Figure 5:
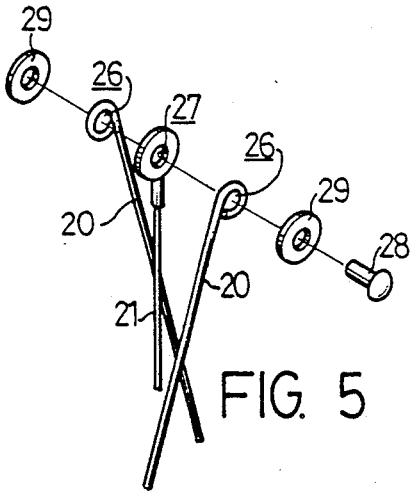
FIG. 5 is a close-up exploded view of the umbrella frame of FIG. 2 showing the connection of the rib and the brace thereof.

Referring next to FIG. 5, it can be seen that each looped-shaped rib 20 is composed of a pair of support ribs each having a hole 26 at the upper end and each brace 21 has a hole 27 at the upper end. The two ribs of the looped-shaped rib 20 and the brace 21 are engaged together by suitable fastening means, such as a nut 28. It is also preferable that the engagement thereof is sandwiched with washers or pads 29.

Figure 6:
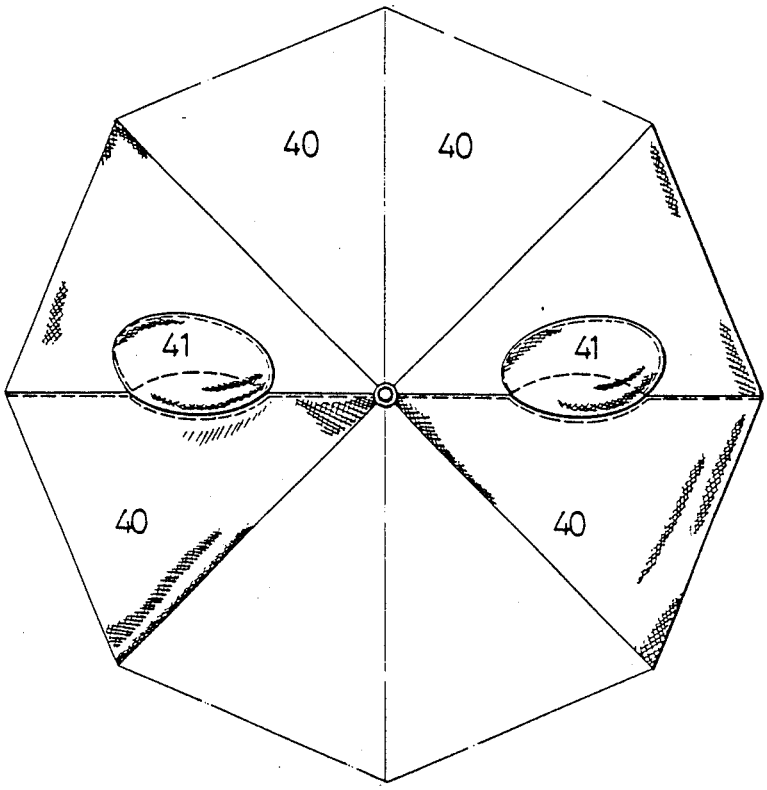
FIG. 6 is a bottom view of the umbrella frame of FIG. 2 covered with canopy.

Referring next to FIG. 6, it can be seen that a canopy 40 is stitched on each region of the umbrella frame 10 so as to fully cover the umbrella frame 10 except the extraneous part defined by the looped-shaped ribs 20. As for the extraneous part defined by the looped-shaped ribs 20, it is covered by two side canopies 41 corresponding to the contour defined by the looped-shaped ribs 20.

Figure 7:
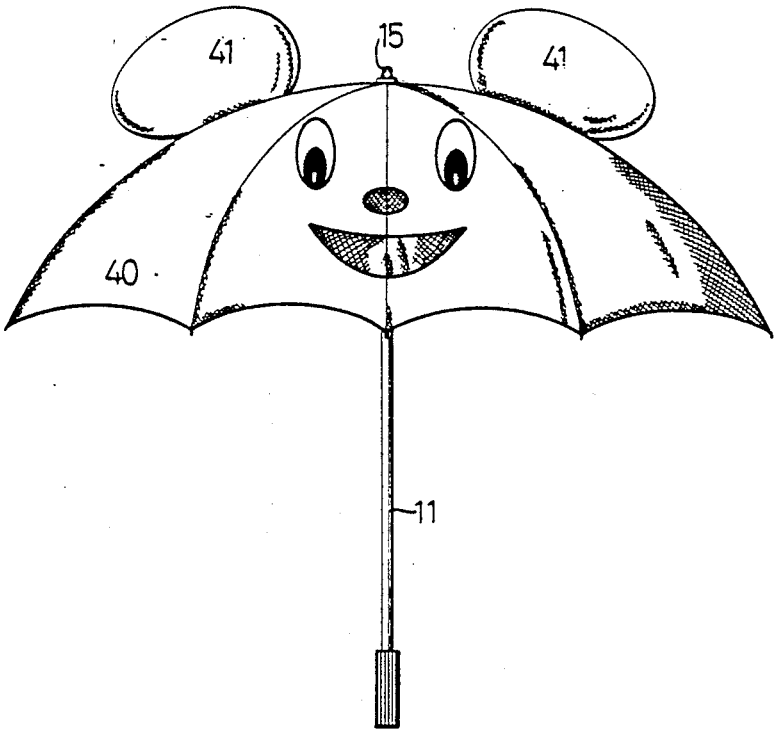
FIG. 7 is a side elevational working view of an umbrella frame of FIG. 2 covered with canopy.

Referring next to FIG. 7, it can be seen that the umbrella frame 10 having the afore-mentioned looped-shaped ribs 20, after being covered with canopy, provides an umbrella having a pair of mock animal ears protruded from the normal dome-shaped canopy surface. The external surface of the canopy can be drawn or colored with a picture of the face of an animal or cartoon. Thus, an extraordinaryly attractive umbrella is formed.

Although this invention has been described with a certain degree of particularity, it is to be understood that the present disclosure is made by way of example only and that numerous changes in the detail of construction and the combination and the arrangement of parts may be resorted to without departing from the spirit and scope of the invention as hereinafter claimed.

I claim:

1. An umbrella frame comprising a stick, a plurality of outer dome ribs, a plurality of struts, and a plurality of stretcher members, wherein said stick is provided with a crown at an upper end thereof and is provided with a runner which is slidable therealong; said crown being connected to said stretcher members, said runner being connected to said struts and each, said strut being connected to said runner at one end and to a first pivotal joint on said stretcher member at another end, each said stretcher member being connected to said crown at one end thereof and to one of said first pivotal joints at another end thereof; said umbrella frame characterized in that: said umbrella frame further comprises two looped-shaped ribs on said runner, two braces each having ends, and each being connected at one end to a second pivotal joint on one of said stretcher members and at another end to said looped-shaped ribs so as to support said looped-shaped ribs, and two catchers formed on two corresponding stretcher members between said first pivotal joint and said second pivotal joint for fixing each of the corresponding looped-shaped ribs.

2. An umbrella frame as claimed in claim 1, wherein two end portions of said looped-shaped rib are joined together by a sleeve.

3. An umbrella frame as claimed in claim 1, wherein the connection part of each rib and each brace is covered by a cover cloth.

4. An umbrella frame as claimed in claim 1, wherein said runner is a sleeve-type runner and includes an upper, middle, and lower annular protrusion.

5. An umbrella frame as claimed in claim 4, wherein said upper annular protrusion includes a plurality of first cutouts for pivotal engagement with said plurality of struts.

6. An umbrella frame as claimed in claim 4, wherein said middle annular protrusion includes two second cutouts for pivotal engagement with both end portions of the looped-shaped rib being joined together by a sleeve.

7. An umbrella frame as claimed in claim 1, wherein said lower annular protrusion provides a part for a user to push upon so as to open the umbrella.

8. An umbrella frame as claimed in claim 1, wherein each said pair of ribs has a hole at each rib end and said brace having a hole at the brace end are engaged together by a nut.

* * * * *